US006188211B1

(12) United States Patent
Rincon-Mora et al.

(10) Patent No.: US 6,188,211 B1
(45) Date of Patent: Feb. 13, 2001

(54) CURRENT-EFFICIENT LOW-DROP-OUT VOLTAGE REGULATOR WITH IMPROVED LOAD REGULATION AND FREQUENCY RESPONSE

(75) Inventors: Gabriel Alfonso Rincon-Mora, Allen; Marco Corsi, Plano, both of TX (US)

(73) Assignee: Texas Instruments Incorporated, Dallas, TX (US)

( * ) Notice: Under 35 U.S.C. 154(b), the term of this patent shall be extended for 0 days.

(21) Appl. No.: 09/309,991

(22) Filed: May 11, 1999

Related U.S. Application Data

(60) Provisional application No. 60/085,356, filed on May 13, 1998.

(51) Int. Cl.[7] ..... G05F 1/575

(52) U.S. Cl. ..... 323/280; 323/273; 323/281; 323/315

(58) Field of Search ..... 323/273, 277, 323/280, 281, 313, 315

(56) References Cited

U.S. PATENT DOCUMENTS

| | | | | |
|---|---|---|---|---|
| 5,274,323 | * | 12/1993 | Dobkin et al. | 323/280 |
| 5,481,178 | * | 1/1996 | Wilcox et al. | 323/287 |
| 5,563,501 | * | 10/1996 | Chan | 323/282 |
| 5,570,060 | * | 10/1996 | Edwards | 327/541 |
| 5,731,694 | * | 3/1998 | Wilcox et al. | 323/287 |
| 5,850,139 | * | 12/1998 | Edwards | 323/280 |
| 5,852,359 | * | 12/1998 | Callahan, Jr. et al. | 323/274 |
| 5,929,616 | * | 7/1999 | Perraud et al. | 323/274 |
| 5,994,885 | * | 11/1999 | Wilcox et al. | 323/285 |

OTHER PUBLICATIONS

Rincon–Mora et al., "A Low–Voltage, Low Quiescent Current, Low Drop–Out Regulator," *IEEE Journal* of Solid–State Circuits, vol.33, No. 1, Jan. 1998, pp. 36–44.

* cited by examiner

*Primary Examiner*—Adolf Deneke Berhane
(74) *Attorney, Agent, or Firm*—W. Daniel Swayze, Jr.; W. James Brady, III; Frederick J. Telecky, Jr.

(57) ABSTRACT

A low drop-out (LDO) voltage regulator (10) and system (100) including the same are disclosed. An error amplifier (38) controls the gate voltage of a source follower transistor (24) in response to the difference between a feedback voltage ($V_{FB}$) from the output ($V_{OUT}$) and a reference voltage ($V_{REF}$). The source of the source follower transistor (24) is connected to the gates of an output transistor (12), which drives the output ($V_{OUT}$) from the input voltage ($V_{IN}$) in response to the source follower transistor (24). A current mirror transistor (14) has its gate also connected to the gate of the output transistor (12), and mirrors the output current at a much reduced ratio. The mirror current is conducted through network of transistors (18, 22), and controls the conduction of a first feedback transistor (28) and a second feedback transistor (35) which are each connected to the source of the source follower transistor (24) and in parallel with a weak current source (34). The response of the first feedback transistor (28) is slowed by a resistor (32) and capacitor (30), while the second feedback transistor (35) is not delayed. As such, the second feedback transistor (35) assists transient response, particularly in discharging the gate capacitance of the output transistor (12), while the first feedback transistor (28) partially cancels load regulation effects.

20 Claims, 3 Drawing Sheets

CURRENT-EFFICIENT LOW-DROP-OUT VOLTAGE REGULATOR WITH IMPROVED LOAD REGULATION AND FREQUENCY RESPONSE

This application claims benefit to U.S. provisional application Ser. No. 60/085,356, filed May 13, 1998.

BACKGROUND OF THE INVENTION

This invention is in the field of integrated circuits, and is more specifically directed to voltage regulator circuits of the low dropout type.

As is fundamental in the art, voltage regulator circuits are commonly used circuits for generating a stable voltage from an input voltage supply that may vary over time, and over varying load conditions. Especially in automotive applications and in battery-powered systems, the demand is high for voltage regulators that can generate a low-noise stable output voltage with a minimum difference in potential between the input voltage and the regulated output voltage (the minimum potential difference is referred to as the "drop-out" voltage). Typical modern low drop-out (LDO) voltage regulators have drop-out voltages that are on the order of 200 mV.

Modern portable electronic systems, such as wireless telephones, portable computers, pagers, and the like also present additional requirements upon voltage regulator circuits. As known in the art, many modern integrated circuits are operating at increasingly lower power supply voltages, with 3.3 V power supply voltages now common in these systems, and with sub-1-V power supply voltages expected within the near future. These low power supply voltages are greatly desirable in portable electronic systems, because of their improved reliability, power efficiency, and battery longevity. Additionally, because voltage regulator circuits must remain operable at all times, the quiescent current drawn by these circuits is an important characteristic, as any reduction in this quiescent current translates directly into longer battery life. Finally, the fast switching times and high frequencies at which modem integrated circuits operate in turn require excellent frequency response on the part of the voltage regulator circuitry.

An example of a modem LDO voltage regulator is described in Rincon-Mora, et al., "A Low-Voltage, Low Quiescent Current, Low Drop-Out Regulator", *Journal of Solid-State Circuits*, Vol. 33, No. 1 (IEEE, January, 1998), pp. 36–44. As described therein, a current mirror circuit generates a significant boost current to assist an emitter follower at the output of the error amplifier, improving the slew-rate performance of the regulator while maintaining stability throughout the load-current range. In effect, the current mirror pushes the parasitic pole at the emitter of the emitter follower to a higher frequency during high load-current conditions, matching the increase in frequency of the required placement of this pole with increasing load current. Absent the current mirror and the resulting movement of the parasitic pole, more quiescent current flow than is necessary at low load current conditions would be required to ensure stability at high load currents. The current mirror ratio is preferably maintained relatively high to minimize power consumption.

By way of further background, copending application Ser. No. 08/992,706, filed Dec. 17, 1997, entitled "A Low Drop-Out Voltage Regulator With PMOS Pass Element", commonly assigned herewith and incorporated by reference hereinto, describes another LDO voltage regulator. In this regulator, a positive feedback path is provided from the current mirror to a source follower that is controlled by the output of the error amplifier; the positive feedback modulates the gate-to-source voltage of the source follower proportionally with the output device, to compensate the source follower for changes in the output impedance of the regulator. In this circuit described in this copending application, the positive feedback path includes an RC network to slow the response of the positive feedback relative to negative feedback provided to the error amplifier, in order to prevent oscillation of the circuit. Of course, this RC network reduces the bandwidth of the frequency response of the positive feedback.

BRIEF SUMMARY OF THE INVENTION

It is therefore an object of the present invention to provide a voltage regulator circuit in which load regulation, transient response, and power efficiency may be optimized.

It is a further object of the present invention to provide such a voltage regulator circuit in which the improved performance is obtained with minimal quiescent current flow, especially in low load-current conditions.

It is a further object of the present invention to provide such a voltage regulator circuit which operates at a low dropout voltage.

It is a further object of the present invention to provide such a voltage regulator circuit which is suitable for use in low power supply voltage applications, such as in battery-powered systems.

Other objects and advantages of the present invention will be apparent to those of ordinary skill in the art having reference to the following specification together with its drawings.

The present invention may be implemented in a low drop-out (LDO) voltage regulator circuit having an error amplifier for comparing an output-derived voltage against a reference voltage, and which drives a series pass switch device by way of a source follower. A current mirror is provided, in which a mirror leg conducts a fraction of the current conducted by the series pass switch device. A first positive feedback path, coupled between the current mirror and the source follower, includes an RC delay that stabilizes the feedback loop. A second positive feedback path, also coupled between the current mirror and the source follower but having reduced RC characteristics, discharges parasitic capacitance of the output transistor which appears at the source follower, thus improving the transient response of the voltage regulator.

DETAILED DESCRIPTION OF THE INVENTION

Figure 1:
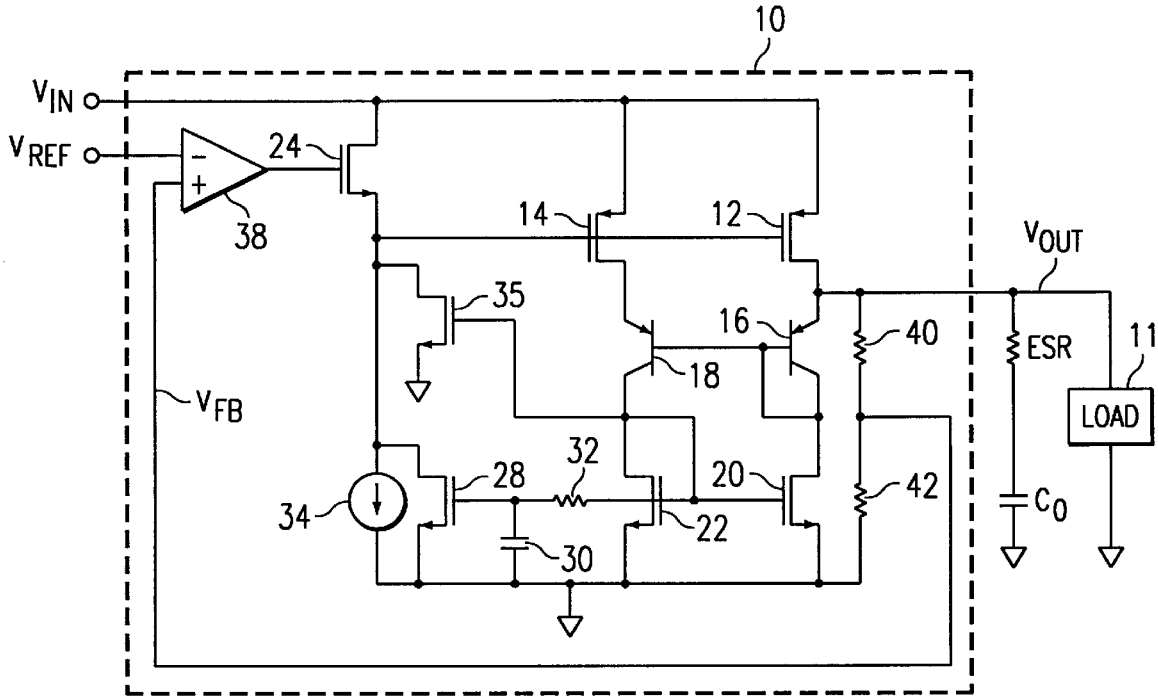
FIG. 1 is an electrical diagram, in schematic form, of a voltage regulator circuit according to the preferred embodiment of the invention.

Referring now to FIG. 1, the construction of low drop-out (LDO) voltage regulator 10 according to the preferred embodiment of the invention will now be described in detail. The construction of voltage regulator 10 of FIG. 1 is suitable for implementation as part of an overall larger integrated circuit or, alternatively, may be realized as a separate stand-alone integrated circuit. It is contemplated that variations in the construction of voltage regulator 10 will become apparent to those of ordinary skill in the art having reference to this specification, and it is further contemplated that such variations are within the scope of the present invention as claimed hereinbelow.

The overall function of voltage regulator 10, as is typical for voltage regulator circuits in the art, is to drive a stable voltage at its output on line $V_{OUT}$, where the output voltage is derived from an input power supply voltage on line $V_{IN}$. Load 11 is connected to line $V_{OUT}$, and is indicative, in this example, of other circuitry in the electronic system (or, in some cases, on the same integrated circuit) which operates based upon the stable regulated voltage on line $V_{OUT}$. As is typical in the art, an external capacitor $C_0$ (with an associated equivalent series resistance represented by resistor ESR) is connected externally to voltage regulator 10, for defining the frequency response of the circuit. As is typical in the art, a reference voltage is provided to voltage regulator 10 on line $V_{REF}$, typically from a reference voltage generator circuit such as a bandgap reference voltage circuit, for use in maintaining a stable output voltage on line $V_{OUT}$.

In the exemplary embodiment of FIG. 1, error amplifier 38 receives the reference voltage on line $V_{REF}$ at a first input. A second input of error amplifier 38 receives, on line $V_{FB}$, a feedback voltage generated from the output of voltage regulator 10. In this example, line $V_{REF}$ is received by the inverting input of error amplifier 38, while the non-inverting input of error amplifier 38 receives the feedback voltage on line $V_{FB}$. Of course, the specific polarity of the inputs receiving the feedback and reference voltages is not essential, so long as error amplifier 38 operates to generate an output signal based on the difference between these two voltages, and so long as the remainder of voltage regulator 10 comprehends the polarity of the differential signal. In other words, the overall loop through voltage regulator 10 has negative feedback.

According to the preferred embodiment of the present invention, error amplifier 38 may be implemented as a conventional differential amplifier, preferably with a current mirror load that permits the desired low voltage operation. Examples of suitable realizations for error amplifier 38 are described in Rincon-Mora, et al., "A Low-Voltage, Low Quiescent Current, Low Drop-Out Regulator", *Journal of Solid-State Circuits*, Vol. 33, No. 1 (IEEE, January, 1998), pp. 36–44, incorporated herein by this reference. Error amplifier 38 will typically have a relatively low gain to ensure stability and to minimize quiescent current.

The output of error amplifier is applied to the gate of n-channel metal-oxide-semiconductor (NMOS) transistor 24, which has its drain receiving the input voltage on line $V_{IN}$ and which has its source connected to, among other elements, the gates of p-channel metal-oxide-semiconductor (PMOS) transistors 12, 14, which are connected together in a current mirror arrangement NMOS transistor 24 thus serves as a source follower stage at the output of error amplifier 38. PMOS transistor 12 is a relatively large device, for driving the regulated output voltage $V_{OUT}$ at its output. According to the preferred embodiment of the present invention shown in FIG. 1, the source follower connection of transistor 24 essentially isolates the relatively large gate capacitance of large PMOS output transistor 12 from the output of error amplifier 38 (which has a relatively large resistive component in its output impedance), and presents a low input capacitance to the output of error amplifier 38 and a relatively low output impedance to transistor 12. Furthermore, transistor 24 serves as a class "A" source follower stage, which provides a sufficiently large voltage swing at its source (up to a threshold voltage drop from line $V_{IN}$) as to be capable of turning off PMOS output transistor 12, at least deep into its subthreshold region. As such, NMOS transistor 24 is preferably a "natural n-channel transistor" (i.e., without a threshold adjust implant), so as to have a relatively low threshold voltage, permitting its source voltage to rise very close to the voltage on line $V_{IN}$.

In the output leg of voltage regulator 10, PMOS transistor 12 has its source receiving input voltage $V_{IN}$, and its drain driving the output voltage on line $V_{OUT}$. As mentioned above, the gate of transistor 12 is driven from the source of NMOS transistor 24, responsive to the output of error amplifier 38. Negative feedback to error amplifier 38 is generated on line $V_{FB}$ by a resistor divider of resistors 40, 42, which are preferably of relatively high resistance values to minimize quiescent current therethrough; line $V_{FB}$ is taken from the node between resistors 40, 42, and applied to the non-inverting input of error amplifier 38.

As noted above, PMOS transistor 14 is provided in voltage regulator 10 to mirror the output current through PMOS output transistor 12, and as such has its source receiving the input voltage on line $V_{IN}$ and its gate driven by the source follower stage of transistor 24. In order to minimize quiescent current, mirror PMOS transistor 14 is preferably much smaller, in drive capability, than output PMOS transistor 12, for example on the order of 1000 times smaller. As such, while the current through transistors 12, 14 mirror one another, the current through mirror transistor 14 is much smaller than that through output transistor 12.

Bipolar p-n-p transistors 16, 18 have their emitters connected to the drains of PMOS transistors 12, 14, respectively. The bases of transistors 16, 18 are connected in common, and to the collector of transistor 16; the collectors of transistors 16, 18 are further connected to the drains of NMOS transistors 20, 22, respectively, which have their sources at ground. The gates of transistors 20, 22 are connected together, and to the drain of transistor 22. The circuit of transistors 16, 18, 20, 22 is provided to equalize the drain-to-source voltages of transistors 12, 14 relative to one another, and thus maintain proper current mirroring, given the extremely large (e.g., 1000:1) ratio of drive between these transistors. Also, because voltage regulator 10 is preferably of the low dropout (LDO) type, the circuit including bipolar transistors 16, 18 also serves to maintain the drain-to-source voltages of transistors 12, 14 equal to one another even in a "drop-out" condition (e.g., when $V_{IN} \approx V_{OUT}$ at startup, or due to a drained battery), to minimize the current that may otherwise be required to be conducted through small mirror PMOS transistor 14.

As illustrated in FIG. 1, the source of NMOS source follower transistor 24 is connected to current source 34, which sinks current from the source of transistor 24 to ground. Current source 34 is implemented in the conventional manner, for example by way of an NMOS transistor with its gate biased by a reference voltage. Current source 34 is preferably a very small device, or is biased so as to conduct very little current, in order to minimize quiescent current through the path of NMOS transistor 24 and current source 34, while still conducting sufficient current to stabilize voltage regulator 10 in low load-current conditions.

Similarly as the circuit described in copending application Ser. No. 08/992,706, incorporated hereinabove by reference, voltage regulator 10 includes a first positive feedback network which includes NMOS transistor 28 having its source-drain path connected in parallel with current source 34, and having its gate controlled by the node at the drain of transistor 22 (and gates of transistors 20, 22), via series resistor 32 and shunt capacitor 30. The drive of NMOS transistor 28 is preferably larger than that of NMOS transistors 20 and 22, so that in the event of increased current through PMOS output transistor 12 (mirrored through transistors 14, 18, 22), transistor 28 turns on and changes the gate-to-source voltage of NMOS transistor 24 by an amount that is approximately equal to or greater than the change in the gate-to-source voltage of PMOS transistor 12. This operation tends to cancel the load regulation effect, as will be described in further detail hereinbelow. The rate at which transistor 28 turns on to accomplish this function is controlled according to the values of resistor 32 and capacitor 30, to prevent oscillation.

According to the preferred embodiment of the present invention, voltage regulator 10 further includes a second feedback path of NMOS transistor 35, which has its source-drain path also in parallel with current source 34. In this embodiment of the invention, the RC delay at the gate of transistor 35 is much lower than that presented by resistor 32 and capacitor 30. In this example, the gate of transistor 35 is connected directly to the drain of NMOS transistor 22, and thus in common with the gates of transistors 20, 22. As such, only the parasitic gate capacitance of transistor 35 itself, and the series resistance of the interconnection to the gate of transistor 35, will affect the switching time of transistor 35, and as such the response of transistor 35 to variations in voltage at its gate is relatively fast.

Figure 3:
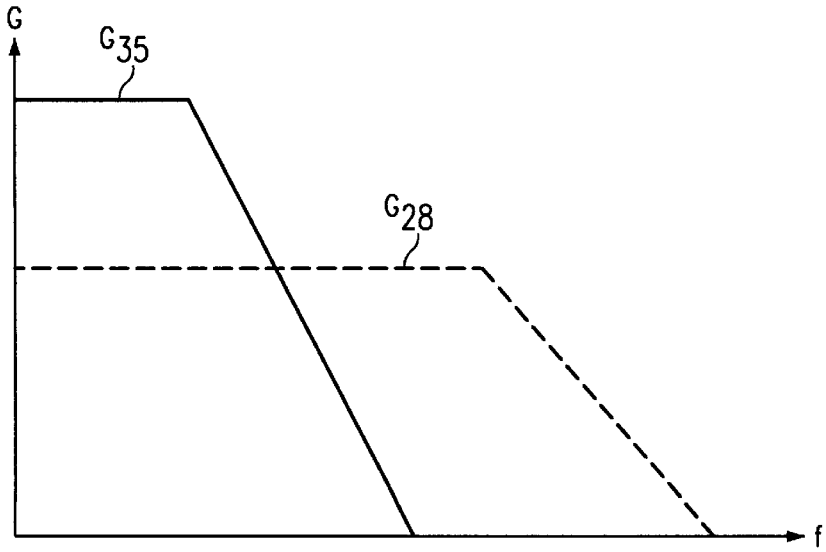
FIG. 3 is a frequency response plot illustrating the relative gain, over frequency, of the positive feedback paths in the voltage regulator circuit according to the preferred embodiment of the invention.

According to the preferred embodiment of the invention, the size of transistor 35 is typically relatively small, somewhat smaller than that of transistor 28, depending upon the desired transient response of voltage regulator 10. Referring now to FIG. 3, the relative frequency response of transistors 28, 35 over frequency, according to the preferred embodiment of the invention, is illustrated. In FIG. 3, curves $G_{28}$, $G_{35}$ illustrate the gain versus frequency (both on a log scale) of transistors 28, 35, respectively. At low frequencies, transistor 28 has a higher gain than transistor 35, but at higher frequencies transistor 35 has a higher gain than does transistor 28, because of the fall-off of the frequency response of transistor 28 due to capacitor 30 and resistor 32. Accordingly, transistor 35 has a smaller gain but a higher bandwidth, in the amplifier sense, than does transistor 28. In general, transistor 35 is included in voltage regulator 10 according to the preferred embodiment of the present invention, to provide a "boost" current path (i.e., positive feedback), at the source of NMOS transistor 24, that is able to rapidly respond to transient events, thus improving the overall transient response of voltage regulator 10. Transistors 28 and 35 cumulatively provide steady-state conduction from the source of transistor 24 during high load-current conditions, to maintain stability. The relatively low gain of transistor 35 at low frequencies prevents oscillation as voltage regulator 10 reaches a steady state (or at least until transistor 28 responds to the load variation, as controlled by the RC network of resistor 32 and capacitor 30).

Of course, while two positive feedback transistors 28, 35 with varying frequency response are provided in voltage regulator 10 according to the preferred embodiment of the invention, it is contemplated that further optimization of voltage regulator 10 may be accomplished by providing still additional positive feedback devices with different frequency response characteristics. It is expected that those of ordinary skill in the art having reference to this specification will be readily able to optimize circuit operation with two or more positive feedback devices, through design of the frequency response and associated RC delays.

As described in copending application Ser. No. 08/992,706, the positive feedback provided by transistor 28 improves load regulation by modulating the gate-to-source voltage of source follower NMOS transistor 24 proportionately with the gate-to-source voltage of output PMOS transistor 12. As is known in the art, load regulation refers to the magnitude of variation in the regulated output voltage on line $V_{OUT}$ over the possible range of load conditions, and thus over the possible range of output current sourced by PMOS output transistor 12. Load regulation, in his example, is a function of the loop gain of voltage regulator 10, of the output resistance of PMOS output transistor 12, and of the systematic offset voltage performance of the feedback loop of resistors 40, 42, and error amplifier 38. In particular, in this embodiment of the invention, systematic offset voltage in the feedback loop significantly affects load regulation, considering that the loop gain is maintained low in order to meet the desired frequency response, and because the gate voltage of PMOS output transistor 12 swings over a relatively large range (on the order of 0.5 volts), depending upon its aspect ratio and upon the range of load currents therethrough.

On the other hand, because of the presence of resistor 32 and capacitor 30 to prevent oscillation, transistor 28 will not turn on quickly enough to provide suitable transient response, for example in the event of rapid changes in load current through load 11, or in the input voltage on line $V_{IN}$. Transistor 35, although of relatively low gain, is able to respond quickly to such transient events, so that the output voltage on line $V_{OUT}$ settles quickly after such events.

Figure 2A:
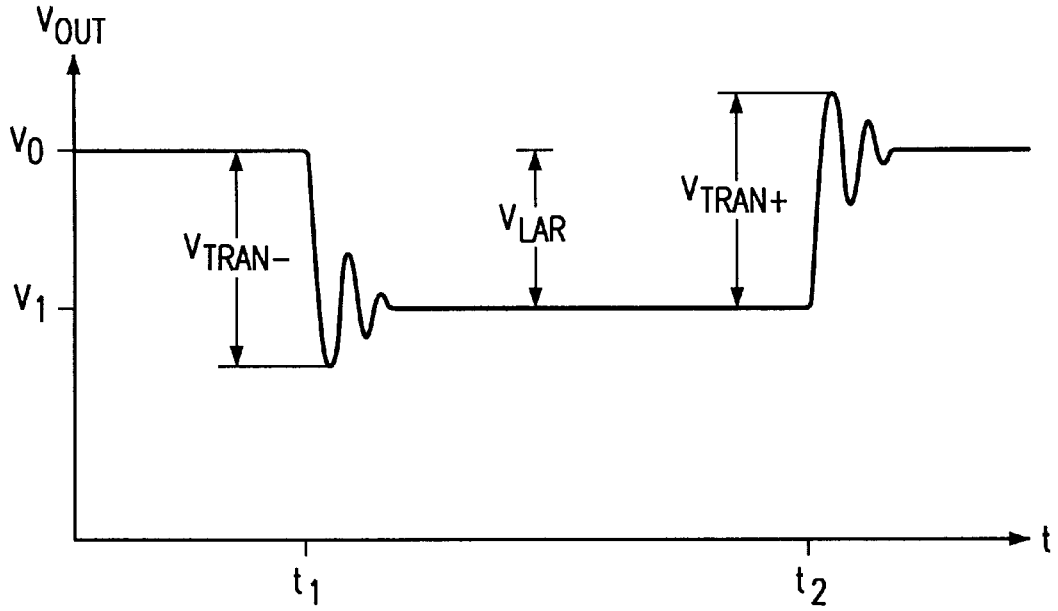
FIGS. 2*a* and 2*b* are timing diagrams illustrating the operation of the circuit of FIG. 1.
Figure 2B:
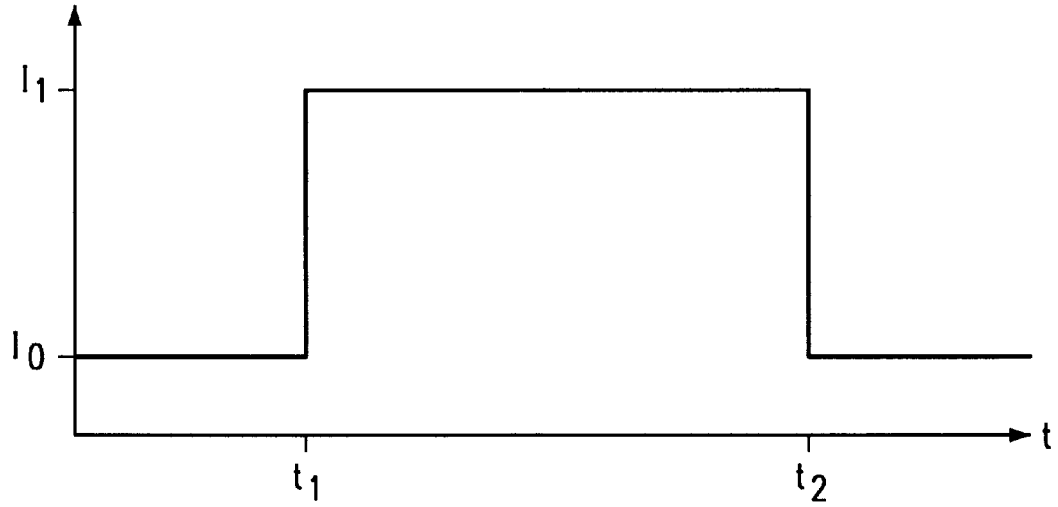

Referring now to FIGS. 2*a* and 2*b*, the operation of voltage regulator 10 according to the preferred embodiment of the present invention will now be described in detail. FIG. 2*a* illustrates the behavior of output voltage $V_{OUT}$ in response to changes in the load current $I_{load}$ drawn by load 11 in the example of FIG. 1, as illustrated in FIG. 2*b*. In the example of FIGS. 2*a* and 2*b*, a sudden increase in load current $I_{load}$ occurs at time $t_1$, and a sudden decrease in load current $I_{load}$ occurs at time $t_2$.

Prior to time $t_1$ of FIGS. 2*a*, and 2*b*, a relatively low level load current $I_0$ is being sourced by PMOS output transistor 12 through load 11; at this time, the output voltage on line $V_{OUT}$ is at a level $V_0$, which will be near the reference voltage $V_{REF}$ in the steady state. At this time prior to the transition, the gate-to-source voltage at PMOS output transistor 12 is relatively small as required to produce the relatively low load current $I_0$,; the gate voltage of transistor 12 is, of course, under the control of error amplifier 38 via source follower 24.

At time $t_1$ in this example, the condition of load 11 changes so as to require additional current, up to current $I_1$ as shown in FIG. 2*b*. The additional current ($I_1$–$I_0$) must, of course, be sourced by PMOS output transistor 12. Since the gate of transistor 12 is controlled by way of error amplifier 38, conduction through transistor 12 does not change immediately. The additional load current demand is thus initially supplied from capacitor $C_0$, which causes the output voltage on line $V_{OUT}$ to begin to fall toward ground, as illustrated in FIG. 2*a*. This reduction in the output voltage causes a reduction in the feedback voltage on line $V_{FB}$ generated by the resistor divider of resistors 40, 42. Error amplifier 38 responsively reduces the voltage at its output, reducing the voltage at the gate of NMOS source follower transistor 24, which permits the gate of transistor 12 to be discharged to ground through current source 34, and thus to conduct additional current.

However, the capacity of current source 34 is relatively limited, such as on the order of 1 $\mu$A, to minimize quiescent current. This limits the ability of source follower 24 to quickly turn on output PMOS transistor 12 from a low current condition to a high current condition, considering the relatively large gate capacitance of transistor 12 and the relatively small current conducted by current source 34. According to the preferred embodiment of the invention, however, the increased current that begins to be conducted through PMOS output transistor 12 is mirrored by PMOS mirror transistor 14, considering that the drain voltages of transistors 12, 14 are maintained relatively equal through the operation of the circuit of transistors 16, 18, 20, 22. The mirror current through transistor 14 is conducted by p-n-p transistor 18 and NMOS transistor 22 and, because this mirror current is increasing, the voltage at the gate of transistor 35 rises, turning on transistor 35 and opening another current path for the discharge of the gate of transistor 12 to ground, further increasing the magnitude of the gate-to-source voltage of transistor 12 and increasing its conduction. As such, transistor 35 provides positive feedback to the operation of voltage regulator 10 in response to this transient event, accelerating its response to the sudden load current demand increase. This positive feedback is especially important in the transition from low load current to a higher load current, conversely, for the transition from high load current to low load current, source follower transistor 24 is not limited in its current drive, and is therefore quite capable of switching the state of PMOS output transistor 12 without positive feedback.

As the gate capacitance of PMOS output transistor 12 is discharged toward ground through transistor 35 and current source 34, transistor 12 thus provides additional load current $I_{load}$, responsive to which the output voltage on line $V_{OUT}$ rises (as capacitor $C_0$ charges) and is reflected by error amplifier 38. Due to the conduction through transistors 14, 18, and 22, transistor 35 remains on throughout this transient event, and also remains on into the steady-state high load-current condition. The negative transient voltage $V_{tran-}$ measurement is the differential voltage between the starting voltage $V_0$ and the lowest peak voltage, as shown in FIG. 2*a*. The presence of the second, low-gain, fast response feedback path comprised of transistor 35 reduces this negative transient voltage $V_{tran-}$ from that which is attainable in conventional circuits that conduct similar quiescent current. The extent to which ripple remains in the voltage on line $V_{OUT}$ is primarily due to the phase margin of voltage regulator 10.

The voltage level $V_1$ to which the output voltage on line $V_{OUT}$ settles, in a high load current condition (load current $I_{load}$ at level $I_1$) is determined by the load regulation capability of voltage regulator 10. In voltage regulator 10, the load regulation voltage differential $V_{LAR}$ may be expressed as:

$$V_{LAR} = \frac{R_{12\text{-}on}}{1 + AB} + \frac{\Delta V_{gs12} - \Delta V_{gs24}}{A_1}$$

where A corresponds to the open loop gain (to $V_{OUT}$), where $A_1$ corresponds to the open loop gain of error amplifier 38 (i.e., to the gate of transistor 24), where $R_{12\text{-}on}$ is the on-resistance of transistor 12, and where the gate-to-source voltage differentials $\Delta V_{gs12}$, $\Delta V_{gs24}$ refer to the differentials as a result of the transient event. B refers to the feedback gain factor, which is defined in this example as the resistor divider ratio of resistors 40, 42 (i.e., by $$\frac{R_{42}}{R_{40} + R_{42}}.$$

According to the preferred embodiment of the invention, the load regulation voltage differential $V_{LAR}$ is minimized through the operation of transistor 28, under the control of resistor 32 and capacitor 30, which increases the differential gate-to-source voltage $\Delta V_{gs24}$ of transistor 24 in response to a transient event; indeed, the differential gate-to-source voltage $\Delta V_{gs24}$ is preferably increased beyond that of the differential gate-to-source voltage $\Delta V_{gs12}$ so as to partially cancel the first term of the differential load regulation voltage $V_{LAR}$.

This increase in the differential gate-to-source voltage $\Delta V_{gs24}$ occurs in voltage regulator 10 predominantly due to transistor 28 also turning on at some point after the initial transient after time $t_1$, and thus at some point after transistor 35 turns on. The delay time at which transistor 28 turns on is, of course, controlled by the network of resistor 32 and capacitor 30, according to the frequency response discussed above relative to FIG. 3.

A transition from a high load-current condition to a low load-current condition occurs, in this example, at time $t_2$ of FIGS. 2*a* and 2*b*. At a point in time prior to time $t_2$ and after the output voltage on line $V_{OUT}$ has settled, the condition of voltage regulator 10 of FIG. 1 has output PMOS transistor 12 conducting a significant amount of current; this current is mirrored by transistor 14, with this mirror current conducted by transistors 18, 22. The relatively high current through transistor 22 causes transistors 28, 35 to remain on during the steady-state high load current condition, as noted above.

Upon load 11 reducing its load current demand at time $t_2$ in FIGS. 2*a* and 2*b*, the current that is then being conducted by PMOS output transistor 12 initially charges capacitor $C_0$, which raises the voltage on line $V_{OUT}$. This higher voltage is reflected in the feedback voltage on line $V_{FB}$, which in turn causes the output of error amplifier 38 to be driven high, toward input voltage $V_{IN}$. Because transistors 28 and 35 are initially on, however, the voltage at the source of transistor 24 is initially relatively low, which establishes a higher gate-to-source voltage for transistor 24 and thus results in a large gate drive for transistor 24. The current conducted by transistor 24 thus rapidly turns off p-channel transistors 12, 14, quickly reducing the load current sourced from the voltage at line $V_{IN}$ through PMOS output transistor 12.

As the current through PMOS output transistor 12 is reduced, so too is the current through transistors 14, 18, 22; transistors 28, 35 are, in turn, turned off, which assists the voltage at the source of transistor 24 to rise toward the voltage on line $V_{IN}$, considering that the current sink of current source 34 is relatively small. As the load current through PMOS transistor 12 reduces, the voltage on line $V_{OUT}$ will then eventually settle to its steady state low load-current level at $V_0$, as shown in FIG. 2*a*. The transient voltage $V_{tran+}$ corresponds to the transient response of voltage regulator 10 in this transition.

A typical example of voltage regulator 10, according to the preferred embodiment of the invention, will have a gain for error amplifier 38 on the order of 40 to 60 dB, with a unity gain frequency (UGF) of about 1 MHz. Simulation has determined that, assuming an external capacitance of 10 $\mu$F (and assuming no equivalent series resistance ESR), with a connection resistance of 63 mΩ, a pulse in the load current $I_{load}$ of from 10 mA to 100 mA can be handled by voltage regulator 10 with a load regulation voltage differential of 1 mV. Also in this example, the negative transient voltage $V_{tran-}$ on line $V_{OUT}$ was 20 mV, and the positive transient voltage $V_{tran}+$ was 23 mV. Through simulation, this exemplary circuit achieved a quiescent current, at low load-current conditions, of about 20 $\mu$A.

According to the preferred embodiment of the invention, therefore, a voltage regulator circuit is provided which draws an extremely low quiescent current in steady-state, but which provides both excellent transient response and also excellent load regulation. Low drop-out (LDO) operation, such as on the order of 100 mV or lower, is readily obtained according to the preferred embodiment of the invention. The voltage regulator circuit according to this embodiment of the invention also provides these advantages in a circuit which may be efficiently implemented into an integrated circuit according to conventional technology, and is contemplated to be quite stable and robust in operation.

Figure 4:
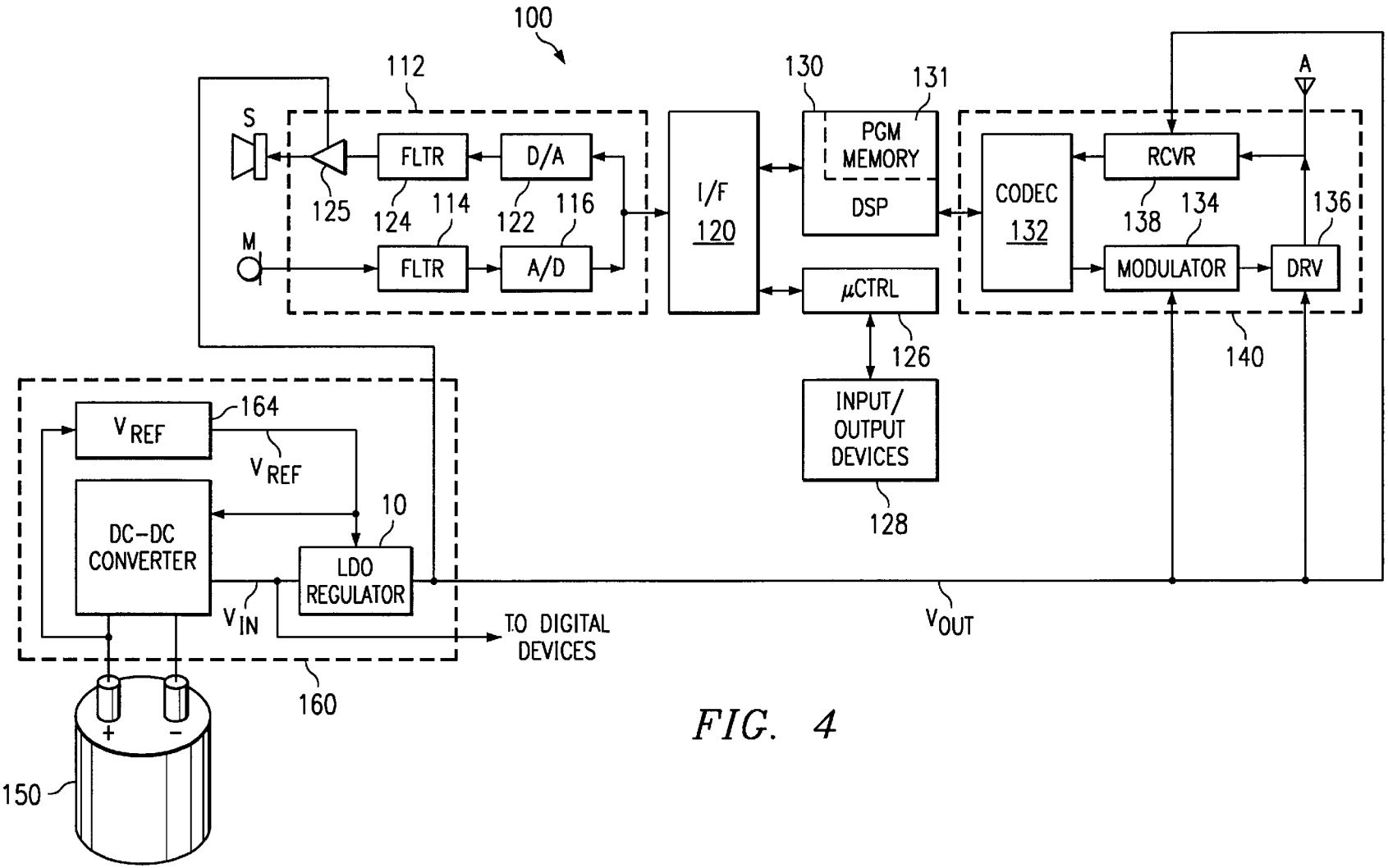
FIG. 4 is an electrical diagram, in block form, illustrating an example of an electronic system, namely a wireless telephone, including the voltage regulator circuit of FIG. 1 according to the preferred embodiment of the invention.

Referring now to FIG. 4, an example of an electronic system incorporating voltage regulator 10 according to the preferred embodiment of the invention will now be described. The system illustrated in FIG. 4 is wireless telephone handset 100, which is an electronic system which particularly benefits from voltage regulator 10, as conservation of battery power and low voltage operation is of particular concern in wireless telephones. The present invention will also be beneficial in other electronic systems, particularly those in which LDO voltage regulators are commonly used to provide dean power supply voltages generated from low voltage power sources, such as batteries. Examples of such systems include laptop or notebook computers, pagers, and automotive applications. Furthermore, the present invention may be implemented as a standalone voltage regulator for microprocessor or personal computer systems, particularly in providing clean power supply voltages to analog circuitry in such systems.

Handset 100 of FIG. 4 includes microphone M for receiving audio input, and speaker S for outputting audible output, in the conventional manner. Microphone M and speaker S are connected to audio interface 112 which, in this example, converts received signals into digital form and vice versa, in the manner of a conventional voice coder/decoder ("codec"). In this example, audio input received at microphone M is applied to filter 114, the output of which is applied to the input of analog-to-digital converter (ADC) 116. On the output side, digital signals are received at an input of digital-to-analog converter (DAC) 122; the converted analog signals are then applied to filter 124, the output of which is applied to amplifier 125 for output at speaker S.

The output of audio interface 112 is in communication with digital interface 120, which in turn is connected to microcontroller 126 and to digital signal processor (DSP) 130, by way of separate buses. Microcontroller 126 controls the general operation of handset 100, and is connected to input/output devices 128, which include devices such as a keypad or keyboard, a user display, and any add-on cards. Microcontroller 126 handles user communication through input/output devices 128, and manages other functions such as connection, radio resources, power source monitoring, and the like. In this regard, circuitry used in general operation of handset 100, such as voltage regulators, power sources, operational amplifiers, clock and timing circuitry, switches and the like are not illustrated in FIG. 1 for clarity; it is contemplated that those of ordinary skill in the art will readily understand the architecture of handset 100 from this description.

In handset 100 according to the preferred embodiment of the invention, DSP 130 is connected on one side to interface 120 for communication of signals to and from audio interface 112 (and thus microphone M and speaker S), and on another side to radio frequency (RF) circuitry 140, which transmits and receives radio signals via antenna A. DSP 30 is preferably a fixed point digital signal processor, for example the TMS320C54x DSP available from Texas Instruments Incorporated, programmed to perform signal processing necessary for telephony, including speech coding and decoding, error correction, channel coding and decoding, equalization, demodulation, encryption, and the like, under the control of instructions stored in program memory 131.

RF circuitry 140 bidirectionally communicates signals between antenna A and DSP 130. For transmission, RF circuitry 140 includes codec 132 which receives digital signals from DSP 130 that are representative of audio to be transmitted, and codes the digital signals into the appropriate form for application to modulator 134. Modulator 134, in combination with synthesizer circuitry (not shown), generates modulated signals corresponding to the coded digital audio signals; driver 136 amplifies the modulated signals and transmits the same via antenna A. Receipt of signals from antenna A is effected by receiver 138, which is a conventional RF receiver for receiving and demodulating received radio signals; the output of receiver 138 is connected to codec 132, which decodes the received signals into digital form, for application to DSP 130 and eventual communication, via audio interface 112, to speaker S.

Handset 100 is powered by battery 150, which is a rechargeable chemical cell of conventional type for wireless telephone handsets. The output of battery 150 is received by power management unit 160. Power management unit 160, in this example, is realized as a single integrated circuit; alternatively, the functions of power management unit 160 may be further integrated with other functions in handset 100, or may be realized as more than one integrated circuit. Power management unit 160 includes DC-DC converter circuit 162, constructed in the conventional manner for converting the voltage from battery 150 into one or more desired operating voltages for use in handset 100. The output of DC-DC converter 162 is illustrated in FIG. 4 as line $V_{IN}$.

Conventional DC-DC converter circuitry typically produces power supply voltages that are somewhat noisy, and that fluctuate to some extent; as such, in handset 100, the voltage on line $V_{IN}$ produced by DC-DC converter 162 will typically include some noise and fluctuation. Because digital circuitry is generally somewhat insensitive to noise and voltage fluctuations at their power supply, the voltage on line $V_{IN}$ may, if desired, be applied directly to digital functions such as DSP 130 and the like within handset 100. Analog functions typically require a steady and noise-free power supply voltage to function accurately. Accordingly, in the example of FIG. 4, power management unit 160 includes one or more LDO voltage regulators 10 (only one of which is illustrated in FIG. 4, for clarity), for producing a stable output power supply voltage on line $V_{OUT}$. Power management unit 160 in this example also includes reference voltage circuitry 164 which produces a reference voltage on line $V_{REF}$ for use by voltage regulator 10 (and also by DC-DC converter 162), generated from the battery voltage. Each of voltage regulators 10 are constructed in the manner described above relative to FIG. 1, and generate a regulated output voltage on line $V_{OUT}$. In the example of FIG. 4, line $V_{OUT}$ is applied to receiver 138, modulator 134, and driver 136 in RF circuitry, and as such powers these sensitive analog circuits. Additionally, the integrated circuit of power management unit 160 may itself include power amplifier 125, which powers speaker S in handset 100, based upon the stable output voltage on line $V_{OUT}$; furthermore, analog filters 114, 124 may also be biased by the stable output voltage on line $V_{OUT}$, if desired.

With the incorporation of LDO voltage regulator 10 into power management unit 160, handset 100 thus benefits greatly from the provision of a stable power supply voltage for bias of its analog functions. These benefits are also available in any system according to the present invention utilizing the voltage regulation approach described hereinabove. This stable and regulated voltage is generated in a manner which requires little quiescent current, and which is capable of low voltage operation, thus conserving battery life. Additionally, the transient response and load regulation achieved according to the present invention is particularly beneficial in providing a stable output voltage, using circuitry which may be efficiently and readily implemented into integrated circuit realizations.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A voltage regulator circuit, comprising:

an error amplifier, having a first input receiving a reference voltage and having a second input, for generating a voltage at an output responsive to a difference in the voltages at its first and second inputs;

a source follower transistor having a gate coupled to the output of the error amplifier, having a drain connected to an input voltage, and having a source;

a current source, coupled between the source of the source follower transistor and a reference bias voltage;

an output leg, comprising an output MOS transistor having a source-drain path coupled between the input voltage and an output node, and having a gate coupled to the source of the source follower transistor;

a mirror leg, comprising a mirror MOS transistor having a source-drain path coupled on one side to the input voltage, and having a gate coupled to the source of the source follower transistor;

a negative feedback circuit coupled to the output node and to the second input of the error amplifier, for providing feedback to the error amplifier based upon the voltage at the output node;

a first positive feedback transistor having a conduction path connected in parallel with the current source, having a control electrode coupled to the mirror leg;

a delay network, coupled to the control electrode of the first positive feedback transistor, for delaying the response of the control electrode of the first positive feedback transistor; and a second positive feedback transistor, having a conduction path connected in parallel with the current source, and having a control electrode coupled to the mirror leg, the second positive feedback transistor having a faster response than the first positive feedback transistor.

2. The voltage regulator of claim 1, wherein the delay network comprises:

a resistor, connected on one side to the control electrode of the first positive feedback transistor, and connected on a second side to the mirror leg; and a capacitor, connected on one side to the control electrode of the first positive feedback transistor, and connected on a second side to a fixed voltage.

3. The voltage regulator of claim 1, wherein the output leg further comprises:

a first bipolar transistor having a collector-emitter path connected on one end to the output node, and having a base connected to another end of the collector-emitter path; and a first MOS transistor having a source-drain path coupled between the collector-emitter path of the first bipolar transistor and the reference bias voltage, and having a gate;

and wherein the mirror leg further comprises:

a second bipolar transistor having a collector-emitter path connected on one end to a second side of the source-drain path of the mirror MOS transistor, and having a base connected to the base of the first bipolar transistor; and a second MOS transistor having a source-drain path coupled between the collector-emitter path of the second bipolar transistor and the reference bias voltage, and having a gate connected to the gate of the first MOS transistor and to the collector-emitter path of the second bipolar transistor.

4. The voltage regulator of claim 3, wherein the control electrode of the first positive feedback transistor and the control electrode of the second positive feedback transistor are coupled to the mirror leg at a node connecting the source-drain path of the second MOS transistor and the collector-emitter path of the second bipolar transistor.

5. The voltage regulator of claim 4, wherein the delay network comprises:

a resistor, connected on one side to the control electrode of the first positive feedback transistor, and connected on a second side to the node connecting the source-drain path of the second MOS transistor and the collector-emitter path of the second bipolar transistor; and a capacitor, connected on one side to the control electrode of the first positive feedback transistor, and connected on a second side to a fixed voltage.

6. The voltage regulator of claim 1, wherein the source follower transistor, and the first and second positive feedback transistors, are each an n-channel MOS transistor.

7. The voltage regulator of claim 6, wherein the mirror MOS transistor and the output MOS transistor are each a p-channel MOS transistor.

8. The voltage regulator of claim 1, wherein the negative feedback circuit comprises a voltage divider.

9. A method of generating a regulated output voltage from an input voltage, comprising:

comparing a feedback voltage based upon the output voltage to a reference voltage;

responsive to the comparing step determining that the feedback voltage is lower than the reference voltage, controlling conduction through a source follower transistor having a drain coupled to the input voltage, and having a source coupled to the gate of an output transistor, so that the output transistor increases the current conducted through a source-drain path connected between the input voltage and an output node;

mirroring the current conducted by the output transistor with a mirror transistor;

responsive to an increase in the mirrored current, turning on a first transistor connected between the source of the source follower transistor and a reference bias voltage, to assist in discharge of the gate of the output transistor; and after the turning on step, turning on a second transistor connected between the source of the source follower transistor and the reference bias voltage.

10. The method of claim 9, further comprising:

delaying the step of turning on a second transistor with a resistor-capacitor network.

11. The method of claim 9, further comprising:

generating the feedback voltage using a resistor divider.

12. The method of claim 9, further comprising:

responsive to the comparing step determining that the feedback voltage is higher than the reference voltage, controlling conduction through the source follower transistor so that the output transistor decreases the current conducted through its source-drain path; and responsive to a decrease in the mirrored current, turning off the first and second transistors.

13. An electronic system, comprising:

a voltage source;

a reference voltage generator circuit;

a load; and a voltage regulator, comprising:

an error amplifier, having a first input receiving a reference voltage from the reference voltage generator circuit and having a second input, for generating a voltage at an output responsive to a difference in the voltages at its first and second inputs;

a source follower transistor having a gate coupled to the output of the error amplifier, having a drain connected to an input voltage from the voltage source, and having a source;

a current source, coupled between the source of the source follower transistor and a reference bias voltage;

an output leg, comprising an output MOS transistor having a source-drain path coupled between the input voltage and an output node coupled to the load, and having a gate coupled to the source of the source follower transistor;

a mirror leg, comprising a mirror MOS transistor having a source-drain path coupled on one side to the input voltage, and having a gate coupled to the source of the source follower transistor;

a negative feedback circuit coupled to the output node and to the second input of the error amplifier, for providing feedback to the error amplifier based upon the voltage at the output node;

a first positive feedback transistor having a conduction path connected in parallel with the current source, having a control electrode coupled to the mirror leg;

a delay network, coupled to the control electrode of the first positive feedback transistor, for delaying the response of the control electrode of the first positive feedback transistor; and a second positive feedback transistor, having a conduction path connected in parallel with the current source, and having a control electrode coupled to the mirror leg, the second positive feedback transistor having a faster response than the first positive feedback transistor.

14. The system of claim 13, wherein the voltage source comprises a battery.

15. The system of claim 14, wherein the voltage source further comprises a DC-DC converter, having an input coupled to the battery and having an output coupled to the voltage regulator.

16. The system of claim 15, wherein the DC-DC converter, the voltage reference generator circuit, and the voltage regulator are implemented within a single integrated circuit.

17. The system of claim 13, wherein the load comprises analog circuitry.

18. The system of claim 13, wherein the output leg further comprises:

a first bipolar transistor having a collector-emitter path connected on one end to the output node, and having a base connected to another end of the collector-emitter path; and a first MOS transistor having a source-drain path coupled between the collector-emitter path of the first bipolar transistor and the reference bias voltage, and having a gate;

and wherein the mirror leg further comprises:

a second bipolar transistor having a collector-emitter path connected on one end to a second side of the source-drain path of the mirror MOS transistor, and having a base connected to the base of the first bipolar transistor; and a second MOS transistor having a source-drain path coupled between the collector-emitter path of the second bipolar transistor and the reference bias voltage, and having a gate connected to the gate of the first MOS transistor and to the collector-emitter path of the second bipolar transistor.

19. The system of claim 18, wherein the control electrode of the first positive feedback transistor and the control electrode of the second positive feedback transistor are coupled to the mirror leg at a node connecting the source-drain path of the second MOS transistor and the collector-emitter path of the second bipolar transistor.

20. The system of claim 19, wherein the delay network comprises:

a resistor, connected on one side to the control electrode of the first positive feedback transistor, and connected on a second side to the node connecting the source-drain path of the second MOS transistor and the collector-emitter path of the second bipolar transistor; and a capacitor, connected on one side to the control electrode of the first positive feedback transistor, and connected on a second side to a fixed voltage.

* * * * *